United States Patent [19]

Rudick et al.

[11] Patent Number: 4,784,678

[45] Date of Patent: Nov. 15, 1988

[54] SELF-COOLING CONTAINER

[75] Inventors: Arthur G. Rudick; Ashis S. Gupta, both of Marietta; Richard H. Heenan, Atlanta, all of Ga.

[73] Assignee: The Coca-Cola Company, Atlanta, Ga.

[21] Appl. No.: 35,122

[22] Filed: Apr. 6, 1987

[51] Int. Cl.[4] ..... F25D 5/02

[52] U.S. Cl. ..... 62/4; 206/217; 206/219; 366/296

[58] Field of Search ..... 62/4, 371; 206/217, 206/219, 222; 366/293, 296, 343; 446/60

[56] References Cited

U.S. PATENT DOCUMENTS

| | | | |
|---|---|---|---|
| 1,313,290 | 8/1919 | Grant | 446/60 |
| 1,897,723 | 2/1933 | Free | 62/4 X |
| 2,460,765 | 2/1949 | Palaith | 62/92 |
| 2,515,840 | 7/1950 | Rodeck | 62/4 |
| 2,556,893 | 6/1951 | Zwiebach et al. | 62/92 |
| 2,746,265 | 5/1956 | Mills | 62/4 |
| 2,757,517 | 8/1956 | Goldberg | 62/92 |
| 2,805,556 | 9/1957 | Wang | 62/92 |
| 2,882,691 | 4/1959 | Robbins | 62/4 |
| 2,900,808 | 8/1959 | Wang | 62/294 |
| 2,968,932 | 1/1961 | Vance et al. | 62/4 |
| 3,003,324 | 10/1961 | Vance et al. | 62/4 |
| 3,134,577 | 5/1964 | Bollmeier | 206/222 |
| 3,229,478 | 1/1966 | Alonso | 62/371 |
| 3,269,141 | 8/1966 | Weiss | 62/294 |
| 3,309,890 | 3/1967 | Barnett et al. | 62/294 |
| 3,326,013 | 6/1967 | Jacobs | 62/294 |
| 3,338,067 | 8/1967 | Warner | 62/264 |
| 3,369,369 | 2/1968 | Weiss | 62/4 |
| 3,373,581 | 3/1968 | Strader | 62/294 |
| 3,494,142 | 2/1970 | Beck | 62/294 |
| 3,494,143 | 2/1970 | Barnett et al. | 62/294 |
| 3,520,148 | 7/1970 | Fuerle | 62/294 |
| 3,525,236 | 8/1970 | Solhkhah | 62/294 |
| 3,597,937 | 8/1971 | Parks | 62/294 |
| 3,620,406 | 11/1971 | Evans | 220/44 |
| 3,636,726 | 1/1972 | Rosenfeld et al. | 62/294 |
| 3,726,106 | 4/1973 | Jaeger | 62/294 |
| 3,759,060 | 9/1973 | Chase | 62/294 |
| 3,803,867 | 4/1974 | Willis | 62/294 |
| 3,842,617 | 10/1974 | Chase et al. | 62/294 |
| 3,852,975 | 12/1974 | Beck | 62/294 |
| 3,881,321 | 5/1975 | Riley | 62/294 |
| 3,919,856 | 11/1975 | Beck | 62/60 |
| 3,970,068 | 7/1976 | Sato | 62/4 X |
| 3,987,643 | 10/1976 | Willis | 62/371 |
| 4,403,868 | 9/1983 | Kupka | 366/296 X |
| 4,640,264 | 2/1987 | Yamaguchi et al. | 62/4 X |

*Primary Examiner*—William E. Tapolcai

[57] ABSTRACT

A self-cooling container for the cooling of a beverage without the use of external refrigeration is provided utilizing an endothermic chemical reaction as the cooling mechanism. The cooling mechanism, located in an inner chamber within the container, is easily and safely actuated.

3 Claims, 2 Drawing Sheets

SELF-COOLING CONTAINER

BACKGROUND OF THE INVENTION

1. Field of the Invention

This invention relates generally to self-cooling containers and more particularly to self-cooling containers having an independent cooling chamber and a simple actuation means for initiating the cooling process and method for using the same.

2. Description of the Art

Many beverages available in portable containers are preferably consumed when they are chilled. For example, carbonated soft drinks, fruit drinks, beer and the like are preferably consumed at temperatures varying between 35° F. and 50° F. When the convenience of refrigerators or ice is not available such as when fishing, camping or the like, the task of cooling these beverages prior to consumption is made more difficult. In such circumstances, it is highly desirable to have a method for rapidly cooling the containers prior to consumption. Thus, a self-cooling container, one not requiring external low temperature conditions, is desirable.

The art is replete with self-cooling containers. Generally, such containers have utilized either a refrigdrant gas or, to a lesser extent, an endothermic reaction to provide the cooling means. Examples of the latter group which include chemical means as the cooling mechanism include U.S. Pat. Nos. 2,746,265, 1,897,723 and 2,882,691. However, at the present time, none of these prior techniques have met with commercial success.

In order for a self-cooling container to have commercial application, it must meet several criteria. For example, the container configuration must be simple and capable of being adapted into current container manufacturing techniques. Second, the cooling mechanism must be such that it is safe, simple, inexpensive and efficient. Last, the actuation technique for initiating the cooling process must be tamper-evident and simple to appeal to the consumer. The prior techniques have not accomplished one or more of the above criteria.

SUMMARY OF THE INVENTION

It is an object of the present invention as set forth herein to provide a self-cooling container and method of for cooling a container which can efficiently and safely cool beverages prior to consumption.

It is another object of this invention to provide a self-cooling container which can be introduced into the container manufacturing industries without major alterations in manufacturing machinery or equipment.

It is yet a further object of this invention to employ an endothermic chemical reaction with inexpensive materials as a self-contained cooling mechanism.

Still a further object of this invention is to provide a self-cooling container which can be easily and safely actuated to initiate the cooling process.

Accordingly, the present invention provides a self-cooling container comprising:

(a) an outer body containing a beverage to be cooled, (b) closure means on the surface of the outer body, and (c) an inner body within the outer body and adjacent to the closure means; said inner body including: (i) a first compartment containing a liquid, (ii) a second compartment containing a chemical that will react when contacted with the liquid to absorb heat, and (iii) a rupturable separator means separating the first and second compartments, the first compartment being accessible through said openable closure means.

In another embodiment the present invention, a self-cooling container is provided wherein the cooling means is actuated upon the opening of the container.

Other embodiments of the present invention are also provided which include mixing means within the inner body to increase the rate of the reaction and therefore the cooling rate. In one embodiment, the mixing means is mechanical while in another embodiment, the mixing means is chemical.

BRIEF DESCRIPTION OF THE DRAWINGS

The objects of the present invention and the associated advantages thereof will become more readily apparent from the following detailed description when taken in conjunction with the following drawings in which.

DETAILED DESCRIPTION OF THE INVENTION

Figure 1:
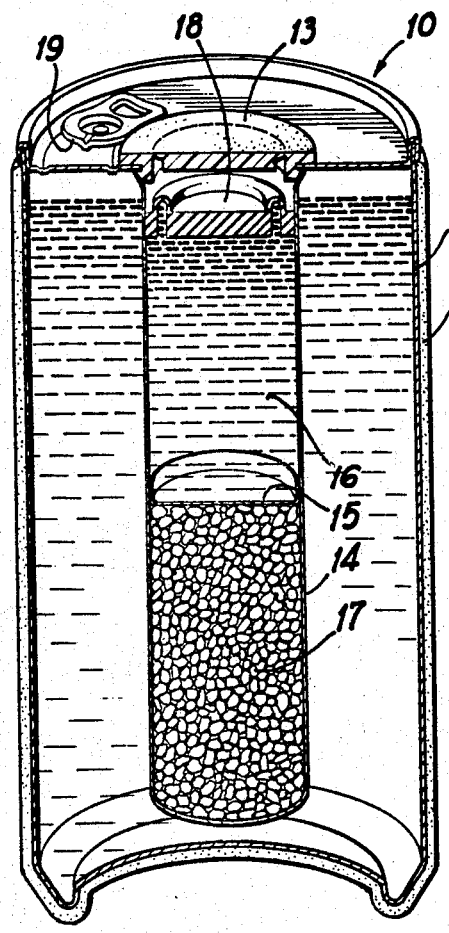
FIG. 1 is a perspective cross-sectional side view of one embodiment of the present invention.

With reference to the drawings, FIG. 1 shows a self-cooling container 10 particularly suited for carbonated soft drinks, fruit drinks, beer and the like. Preferably, the container 10 is a can constructed of conventional materials such as aluminum or other suitable materials. The container 10 has an outer body 11 opening means 19, optional insulation means 12, openable closure means 13 and an inner body 14. The openable closure means 13 provides a tamper-evident function and a means to prevent accidental activation of the cooling mechanism.

The inner body 14 is positioned below openable closure means 13 and has two compartments 16 and 17 which are separated by a rupturable separator means 15. Inner body 14 includes flexible rolling diaphragm 18 which can be exposed by opening openable closure means 13. Openable closure means 13 can be any material which will prevent access to flexible rolling diaphragm 18 until properly opened or removed. Typically, openable closure means 13 can be an adhesive foil, a plastic cap or the like which can be pealed back, opened, or otherwise removed by the consumer.

Compartment 16 of inner body 14 contains a suitable liquid which will both react when in contact with the chemical in compartment 17 and transmit pressure exerted on flexible rolling diaphragm 18 to rupturable separator membrane 15. Typically, the liquid employed will be water although other liquids either organic or inorganic can be employed depending upon the chemical chosen in compartment 17. The chemical in compartment 17 is selected so as to react with the liquid in compartment 16 upon contact thereby absorbing heat. This reaction, known as an endothermic reaction, is the cooling mechanism which will cool the beverage in outer body 11 by heat transfer through the wall of inner body 14. Thus, inner body 14 should be constructed of a suitable heat transfer material and is preferably selected from conventional can manufacturer materials such as steel, aluminum or other metal alloys.

Suitable chemicals for use in compartment 17 can be any material which reacts with the liquid in compartment 16 to absorb heat. Such chemicals are well known in the art. When the liquid is water, typical materials include inorganic salts such as alkali metal halides, perchlorates, ammonium salts or the like. The preferred chemical is ammonium nitrate.

One advantage of the present invention is the ability to manufacture container 10 using conventional manufacturer materials and equipment with minimal adaptation. For example, container 10 can be manufactured with conventional can manufacturing technology by preforming outer body 11, preforming inner body 14, as either an integral part of the can top or as a separate chamber, inserting the cooling means into inner body 14, which can be either separately manufactured as a preformed unit or assembled within inner body 14, and then inserting inner body 14 into the outer body. After sealing container 10 with conventional techniques, the openable closure means 13 can be placed on the container using conventional technology.

The operation of the present self-cooling container 10 is particularly simple lending to quick consumer acceptance. As desired, the consumer lifts or removes the openable closure means 13, applies pressure to the flexible diaphragm 18 with their finger thereby causing the pressure to be exerted upon and rupturing the rupturable separator means 15. Once the rupturable separator means 15 is ruptured, the liquid from compartment 16 enters compartment 17 and reacts with the chemical in compartment 17 causing an endothermic reaction and the resulting cooling of the beverage. The beverage is consumed through opening means 19.

It is important to note that rupturable separator means 15 has sufficient durability to keep the contents of compartment 16 and compartment 17 from coming into contact during normal handling. On the other hand, rupturable separator means 15 must be capable of rupturing upon the exertion of pressure. Typically, the rupturable separator means can be any thin material or membrane such as rubbers, elastomers, films, resins, plastics or the like. Preferably, the material is a elastomer which is stretched or drawn so as to have limited flexibility yet not rupture during normal handling.

Figure 3:
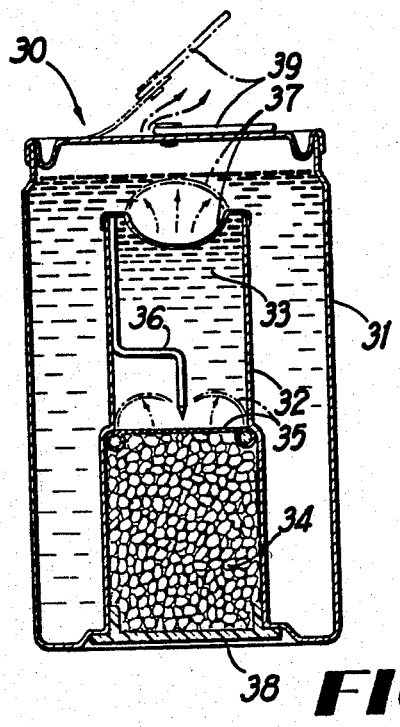
FIG. 3 is a cross-sectional perspective side view of another embodiment of the present invention which self actuates the cooling process upon opening the container.
Figure 4:
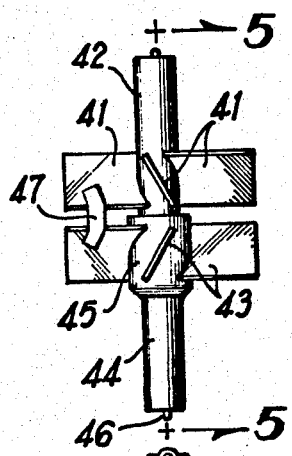
FIG. 4 is a side view of a mechanical mixing apparatus useful in the self-cooling containers of FIGS. 1 and 3.
Figure 5:
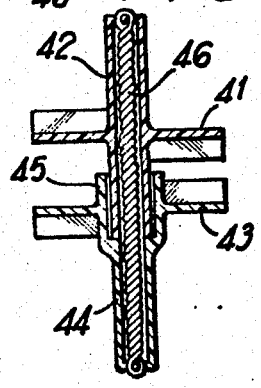
FIG. 5 is a partial cross-sectional view of the mechanical mixing apparatus of FIG. 4.

FIGS. 4 and 5 are illustrations of a mechanical mixing means 40 which can optionally be employed within compartment 17 of inner body 14 of self-cooling container 10 (FIG. 1) or within compartment 34 of inner body 32 of self-cooling container 30 (FIG. 3). Mechanical mixing means 40 has two agitators 41 and 43 located on shafts 42 and 44 respectively. Shaft 42 movably fits into cavity 45 attached at one end of shaft 44. A flexible elastomer 46 such as normal rubber-band, is affixed to the ends of shafts 42 and 44 and wound until sufficient tension is obtained. The tension on flexible elastomer 46 is maintained by applying an adhesive strip 47 to agitators 41 and 43 which is soluble in the liquid employed in compartment 17 of inner body 14 (FIG. 1). Such soluble adhesive strips such as a water soluble tape, are well known in the art. When the liquid of compartment 16 (FIG. 1) is released into compartment 17 (FIG. 1), the adhesive on adhesive strip 47, dissolves thereby releasing the tension on flexible elastomer 46 and allowing the agitators 41 and 43 to rotate in opposite directions. The rotation of agitators 41 and 43 expedite the mixing of the liquid and chemical to increase the rate of the reaction and speed the cooling of the beverage.

Although other mechanical mixing means can be employed as is readily apparent to those skilled in the art, the mechanical mixing means 40 disclosed herein is particularly desirable since it is simple, inexpensive and can be easily inserted into compartment 17 during assembly.

Figure 2:
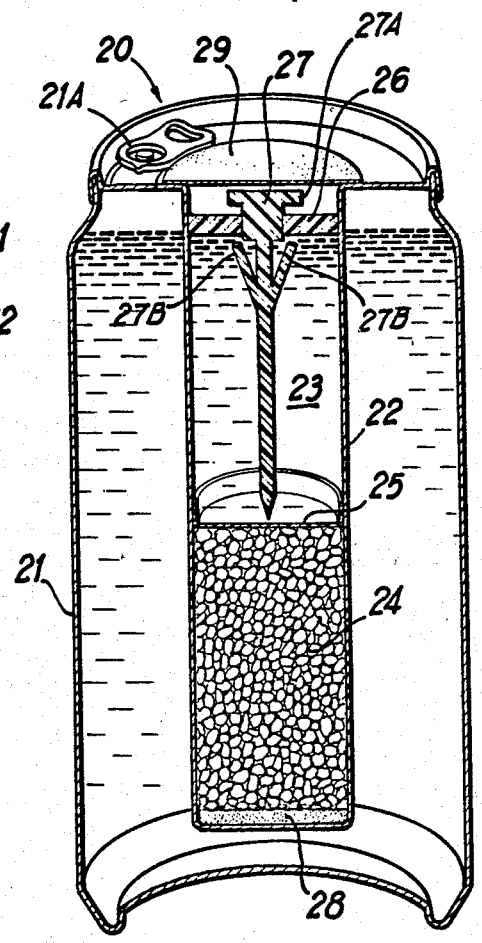
FIG. 2 is a perspective cross-sectional side view of another embodiment of the present invention which utilizes a chemical mixing means and an actuation pin.

FIG. 2 is another embodiment of the present invention which utilizes a chemical mixing means to more rapidly mix the contents of the inner body thereby increasing the rate of the reaction and the speed of the cooling process. Accordingly, self-cooling container 20 has an opening means 21A, an openable closure means 29, an outer body 21 and an inner body 22 with compartments 23 and 24 separated by rupturable separator means 25. The physical relationship of these components is similar to their corresponding components described in FIG. 1. However, inner body 22 has a gas permeable membrane 26 in place of the flexible diaphragm (18 in FIG. 1) and an actuation pin 27 which passes through gas permeable membrane 26, through the liquid in compartment 23 and rests with the cutting end of the pin in close proximity to rupturable separator means 25. Activation pin 27 is accessible through openable closure means 29.

Compartment 24 has a suitable chemical for reacting with the liquid in compartment 23 and also has a chemical mixing means 28 which, when in contact with the liquid, will evolve a gas. The gas so evolved will bubble up through the mixture and expedite the mixing of the chemical and the liquid to increase the rate of the reaction. The gas evolved from the chemical mixing means when in contact with the liquid is vented through the gas permeable membrane 26 and the openable closure means 29 into the atmosphere. The gas so emitted has no appreciable force and is non-toxic.

The actuation pin 27 preferably has a vertically extending cap 27A which keeps the actuation pin 27 from being pushed through the gas permeable membrane 26. Collapsible prongs 27B collapse during insertion and serve to retain the actuation pin 27 from being removed from inner body 22.

Suitable chemical mixing means include any chemical which when in contact with a suitable liquid, such as water, will evolve a non-toxic gas such as oxygen or carbon dioxide. Preferred chemical mixing means include nontoxic salts, such as alkali metal carbonates, and organic acids with baking soda (sodium bicarbonate) and citric acid being especially preferred. Suitable chemical mixing means are readily apparent to one skilled in the art.

The gas permeable membrane 26 can be any porous material which will form a seal with the actuation pin 27, allow the penetration of gas and contain the liquid in compartment 23. Examples of such materials include but are not limited to gas permeable resins, films elastomers, and polymers. Additional fixation means (not shown) can be employed to hold actuation pin 27 in place provided such means do not prohibit the evolved gas from venting.

The operation of self-cooling container 20 is generally similar to that of self-cooling container 10 of FIG. 1. The consumer opens or removes openable closure means 29, applies pressure to actuation pin 27 which punctures rupturable separator means 25 allowing the liquid from compartment 23 to react with the chemical and chemical mixing means 28 in compartment 24. The gas which evolves from the chemical mixing means is vented to atmosphere through gas permeable membrane 26. The beverage is consumed through opening means 21A after a short cooling period.

FIG. 3 is yet another embodiment of the present invention which has been specifically adapted for use with carbonated soft drinks and wherein the cooling mechanism is self-actuated by the opening of beverage container 30. Accordingly, self-cooling container 30 has an outer body 31 and an inner body 32 consisting of two compartments 33 and 34 separated by a rupturable separator means 35. Inner body 32 is affixed to the bottom of container 30 adjacent to cap 38 and has a flexible membrane 37. Flexible membrane 37 can be made of metal or from any materials as described above for the rupturable separator means (35 in FIG. 3) and must be flexible to gasous pressures. The actuation pin 36 is affixed to compartment 33 in a manner such that the cutting end comes into close proximity of rupturable separator means 35.

When outer body 31 is filled with the carbonated beverage and sealed, the flexible membrane 37 of the inner body 32 becomes inverted towards compartment 33. This effect, known in the art as "an oil can effect", is caused because of the carbon dioxide pressure exerted on flexible membrane 37. The inner body 32 is then filled with the liquid, rupturable separator means 35 and chemical and sealed with cap 38. This can be accomplished either by inserting a preformed package of these components or by assembling the individual components within the cavity of inner body 32. When the consumer opens the container 30 with opening means 39, suitably a pop-top or pull-top as known in the art, the carbon dioxide pressure within the can is released. The flexible membrane 37 begins to "oil can" back towards the up position creating a negative pressure on the liquid in compartment 33. The liquid in compartment 33 exerts a pulling force on rupturable separator means 35 pulling it up into contact with actuation pin 36. When rupturable separator means 35 is contacted and punctured, the liquid mixes with the chemical cooling the beverage in outer body 31. It is preferred that rupturable separator means 35 have a sufficient tension causing the puncture hole from actuation pin 36 to enlarge thereby increasing the mixing of the liquid and the chemical.

Optionally, the mechanical mixing means 40 shown in FIGS. 4 and 5 may be used with container 30 by placing it into compartment 34. Other mechanical mixing means could also be employed in compartment 34 as desired.

While the preferred form of the present invention has been shown and described above, it should be apparent to those skilled in the art that the subject invention is not limited by the Figures and that the scope of the invention includes modifications, variations and equivalents which fall within the scope the attached claims. Moreover, it should be understood that the individual components including but not limited to the rupturable separator means, the chemical, the gas permeable membrane, and the chemical mixing means include equivalent embodiments without departing from the spirit of this invention.

What is claimed is:

1. A self-cooling container comprising:

(a) an outer body for the storage of a beverage, (b) an openable closure means located on the surface of said outer body, (c) an inner body within said outer body and adjacent to said openable closure means having a first compartment containing a liquid and a second compartment containing a chemical that will react when contacted with said liquid to absorb heat, separated by a rupturable separator means, and (d) a flexible diaphragm in movable association with said first compartment and accessible through said openable closure means, said flexible diaphragm capable of passing an externally applied force through said liquid and rupturing said rupturable separator means.

2. The container of claim 1 wherein said liquid is water and said chemical is ammonium nitrate.

3. A method for cooling a beverage in a container comprising:

(a) providing a beverage container comprising;

(1) an outer body containing said beverage, (2) openable closure means on the surface of said outer body, (3) an inner body within said outer body and adjacent to said openable closure means; said inner body including: (i) a first compartment containing a liquid, (ii) a second compartment containing a chemical that will react when contacted with said liquid and (iii) rupturable seperator means seperating said first and second compartments, said first compartment being accessible through said openable closure means, and (4) means for rupturing said rupturable separator means, (b) opening said openable closure means to provide access to said first compartment; and (c) rupturing said rupturable seperator means to react said liquid and said chemical to cool said beverage.

* * * * *